United States Patent [19]

Nozaki

[11] 4,136,001

[45] Jan. 23, 1979

[54] NON-SACRIFICIAL ANODE AND WATER HEATER CONSTRUCTION

[75] Inventor: Michio B. Nozaki, LaGrange, Ill.

[73] Assignee: Rheem Manufacturing Company, New York, N.Y.

[21] Appl. No.: 839,006

[22] Filed: Oct. 3, 1977

[51] Int. Cl.[2] ..... C23F 13/00

[52] U.S. Cl. ..... 204/196

[58] Field of Search ..... 204/196

[56] References Cited

U.S. PATENT DOCUMENTS

| | | | |
|---|---|---|---|
| 3,134,731 | 5/1964 | Henze | 204/196 |
| 4,017,714 | 4/1977 | Kreiser | 204/197 |

*Primary Examiner*—Howard S. Williams

*Attorney, Agent, or Firm*—Allegretti, Newitt, Witcoff & McAndrews

[57] ABSTRACT

Non-sacrificial anode for use in a hot water heater has a single elongated electrically conductive wire extending within the interior of the water heater tank. Anode distribution points made of platinum coated tantalum are attached to the conductive wire at pre-selected locations. A catalyst of the type which permits hydrogen gas and oxygen gas at standard temperatures and pressures to form water molecules is suspended from the tank's interior.

18 Claims, 6 Drawing Figures

NON-SACRIFICIAL ANODE AND WATER HEATER CONSTRUCTION

BACKGROUND OF THE INVENTION

This invention relates generally to an improved construction for hot water heaters. These water heaters typically include a storage tank formed as an upright cylinder from steel or ferric metal plate and an anode used to protect the tank from galvanic corrosion. This invention pertains more specifically to a non-sacrificial anode for use in water heater construction which will protect the tank more effectively, efficiently and safely than prior non-sacrificial anodes.

Non-sacrificial anodes generally include one or more elongated filaments of electrically conductive metal impressed with a small electrically positive potential so as to produce direct current from the anode to the metal tank. The current counteracts the corrosive activity of the water and dissolved oxygen to protect the metal tank and fixtures from galvanic corrosion. The voltage of the impressed current is dependent upon, among other things, the quality and characteristics of the lining, the electrical conductivity of the water within the tank, and the configuration of the anode in relation to the tank walls and other metal elements.

Non-sacrificial anodes are deficient in at least two significant aspects. Since the protective current follows the path of least resistance, it will frequently flow directly from the anode to a nearby metal projection, such as the heating elements, leaving the tank walls and remaining fixtures unprotected. It is known to compensate for this limitation by utilizing a higher voltage so that the protective current is applied to all areas of the tank walls and fixtures notwithstanding a relatively greater current drain in some localized area. However, the materials, methods of construction and operating conditions commonly associated with anode and tank are expensive and inherently limited so as to make operation of the tank and non-sacrificial anode system dangerous, especially in certain conditions. The higher voltages associated with certain systems increase the danger.

Expense is related to materials and methods of construction. One conventional type of anode includes a filament of titanium coated with platinum. Use of this type is limited to low voltage systems because the platinum/titanium interfaces break down at voltages above 13 volts. The construction of this type anode generally includes installing the anode as a plurality of short discreet filaments interspaced within the tank in order to avoid proximity between the anode and metal projections within the tank; this requires more materials and labor than single filament systems.

Single filament non-sacrificial anodes are high voltage types of conventional anodes and generally use a tantalum wire coated with platinum as the platinum/tantalum interface will withstand 85 to 100 volts. However, tantalum is more expensive than titanium and the higher voltage increases the dangers associated with non-sacrificial anodes.

The danger associated with non-sacrificial anodes results from an accumulation of hydrogen and oxygen gas generated through the electrolysis of water by the protective current flowing from the anode to the tank and fixtures. The presence of hydrogen and oxygen gas in an enclosed space creates a very real threat of explosion. In normal operating conditions much of the hydrogen and oxygen gases are dissolved in the water flowing through and out of the tank. But when the heater stands idle, as when a homeowner goes on vacation, the static conditions in the tank produce a serious explosion hazard — so serious that no hot water heater, now commercially available and known to this applicant, has received the safety approval of either governmental or non-governmental consumer safety organizations. It can also be seen that the rate of accumulation of the gases depends primarily upon the magnitude of the protective current. Thus the larger the protective current, the more dangerous the explosion potential. This invention improves upon the conventional non-sacrificial anodes and hot water heaters in all of these respects.

SUMMARY OF THE INVENTION

In a principal aspect, the improved hot water heater of the present invention includes a non-sacrificial anode having a single elongated wire with a plurality of discreet anode distribution points. The elongated wire is made of an electrically conductive material and is connected to an external electrical source. The anode distribution points are electrically conductive, chemically stable, galvanically inert, substantially water insoluble and non-toxic. The wire is projected or positioned within the interior of the heater and the anode distribution points are connected to the electrically conductive wire at pre-selected locations. The anode points thus cooperate with the tank to direct a protective positive electrical current from the interior of the tank to the entire area of the tank's interior surface. The non-sacrificial anode further includes a catalyst element of the type which permits hydrogen gas and oxygen gas at standard atmospheric temperatures and pressures to form water molecules. The catalyst, which is disposed at the top of the tank, is chemically stable, inert, substantially water insoluble non-toxic and harmless in contact with food stuffs.

The hot water tank is of a substantially conventional construction comprising a hollow metal tank or shell with at least one opening and an interior surface defining an interior therein. The tank is generally formed, at least in part, of a galvanically active material and is lined with an electrically non-conductive galvanically inert material. The hot water heater also includes a conventional heating element, generally disposed within the interior of the tank.

Thus, it is an object of the present invention to provide a hot water heater and non-sacrificial anode which provides a protective current over the entire interior surface exposed to water. It is a further object of the invention to provide a hot water heater and single filament platinum coated non-sacrificial anode which has a long life even when operating at voltage levels sufficient to protect the entire interior surface of the tank.

One further object of the invention is to provide a hot water heater and non-sacrificial anode having a more economic construction than conventional hot water heaters and non-sacrificial anodes.

Still another object of the invention is to provide a hot water heater and non-sacrificial anode having a safer and more economic operation than conventional hot water heaters and non-sacrificial anodes.

These and other objects, advantages and features will be set forth in the detailed description which follows.

BRIEF DESCRIPTION OF THE DRAWINGS

In the detailed description which follows reference will be made to the drawing comprised of the following figures.

DESCRIPTION OF THE PREFERRED EMBODIMENT

Figure 1:
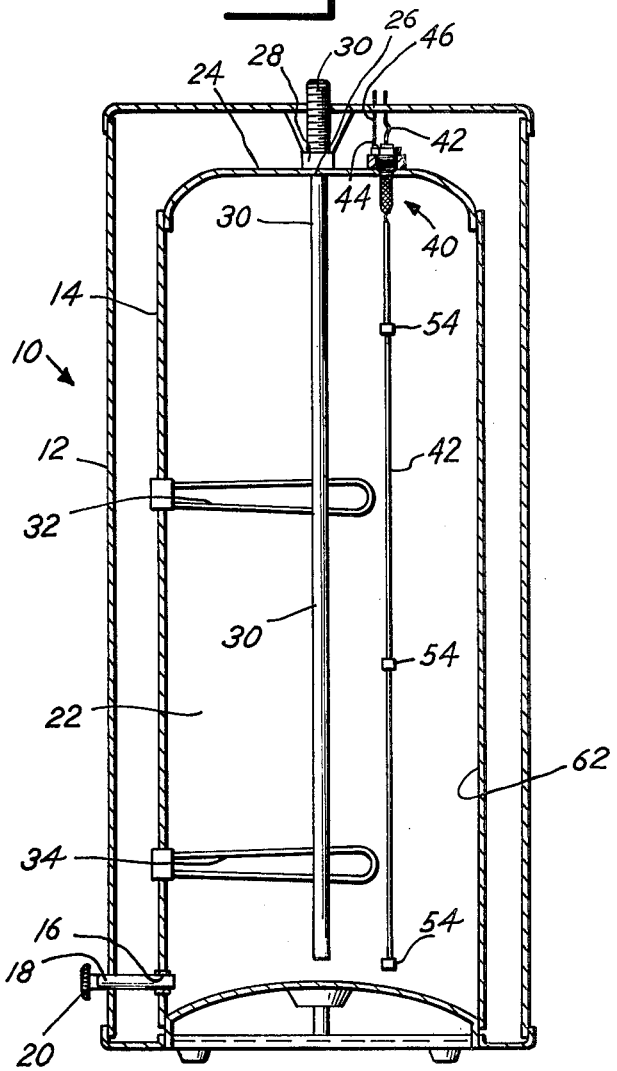
FIG. 1 is a cross-sectional view of a hot water heater showing the preferred form of the improved non-sacrificial anode assembly described herein.

Referring to the Figures, the hot water heater assembly, generally 10, includes an outer casing 12 and a tank 14. The outer casing 12 may be made of metal, ceramic coated metal or plastic, using conventional construction techniques so as to form a shell over the tank 14. The tank 14 is shaped as a cylindrical tube and is formed at least in part from a galvanically active metal using conventional construction techniques. The casing 12 and tank 14 preferably have a drain valve opening 16 near the lower portion of the tank 14 through which a drain valve 18 is affixed. The valve 18 generally has a handle 20 so that any water in the tank 14 can be manually drained. The tank interior 22 is enclosed by a top 24 having a filler pipe opening 26 advantageously positioned near the center thereof. A fixture 28 and filler pipe 30 are affixed to the tank 14 within the opening 26 so that water can be introduced into the tank 14. A first and second heating element 32, 34 of substantially conventional construction are also affixed to the tank 14 and project within interior 22.

Figure 2:
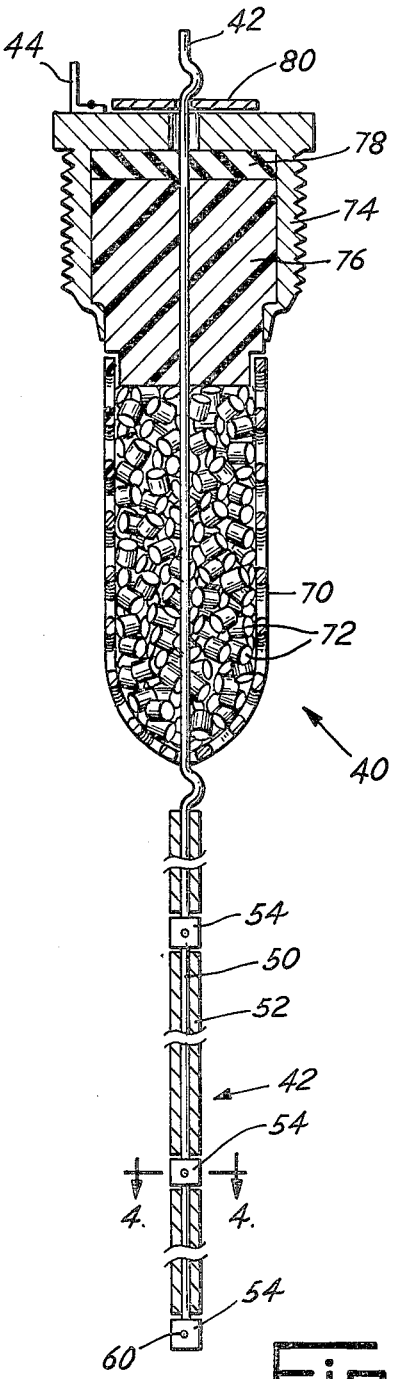
FIG. 2 is a cross-sectional view of the non-sacrificial anode assembly described herein.
Figure 3:
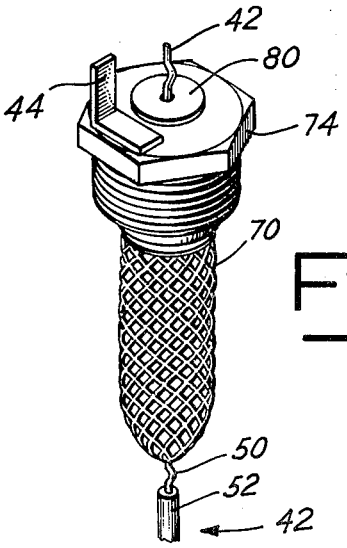
FIG. 3 is a perspective view of a portion of the non-sacrificial anode assembly.

As shown in FIG. 2, the novel non-sacrificial anode 40 of this invention is a single elongated wire 42 attached preferably to the top 24. The wire 42 projects within interior 22, generally extending from the top 24 towards the lower interior of the tank 14. The wire 42 also extends out of the heater assembly 10 for connection with an external source of positive direct current potential. A second post 44 projects from the anode 40 and is attached to a second wire 46 forming an electrical ground.

As best shown in FIG. 2, wire 42 preferably includes an electrically conductive core 50 and an electrically non-conductive, water impermeable covering 52. The material used to make core 50 is advantageously titanium. Tantalum or other electrically conductive materials which form electrically non-conductive, protective films in contact with water may be used. The covering 52 is preferably a conventional plastic material such as polyvinylchloride. The covering should be chemically stable, galvanically inert, substantially water insoluble, non-toxic and harmless when in contact with food stuffs. The covering 52 preferably acts to protect the core material 50 particularly during the initial usage or break-in period of the hot water heater assembly 10.

Figure 4:
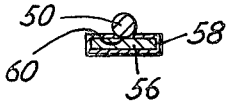
FIG. 4 is a cross-sectional view of the non-sacrificial anode assembly at line 4—4 of FIG. 2.

A plurality of anode distribution points 54 are attached to wire 42, generally by spot welding the anode distribution point directly to the core material 50. The covering 52 is generally removed from the point of attachment prior to welding. As shown in FIG. 4, the anode distribution point includes a flat, rectangular shaped base member 56 covered with a thin coating 58 and spot welded to core 50 at location 60. The base member 56 is preferably made of tantalum or other electrically conductive material which forms an interface with the coating metal capable of withstanding relatively high voltages. The coating 58 is preferably platinum, but may also be any other electrically conductive material which is chemically stable, galvanically inert and which does not form an electrically non-conductive film in contact with water.

The elongated wire 42 preferably extends away from top 24 towards a lower central portion of interior 22. The anode distribution points 54 are generally located at pre-selected locations so that the sum of the electrical resistances between any given localized area of tank 14 and the plurality of anode distribution points 54 is substantially constant. That is, the anode distribution points 54 are located at positions which are spaced substantially equally between the heating elements 32, 34 of the tank 14 and any other conductive projections within interior 22. The protective current distributed from the points 54 are directed to each localized area of the tank 14 as well as to conductive projections such as heating elements 32, 34. It is known through measurements with a calomel reference cell that the requisite d.c. potential of the protective current at the protective coating surface must be at least +0.78 volts with respect to the tank. Applicant has found that the single filament non-sacrificial anode of this invention will provide a protective current having the requisite potential at the coating or interior surface 62 while operating with a total current in the range of 8 to 40 milliamperes, preferably 8 to 16 milliamperes and a total voltage potential from about 1 to about 85 volts, preferably about 20 volts, depending upon the design of the water heater, the anode points, the resistivity of the water, and the placement of the anode distribution points.

A porous basket 70 suspended within interior 22 from the top 24 contains a catalyst 72 of the type which permits hydrogen gas and oxygen gas at standard atmospheric temperatures and pressures to form water molecules. The porous basket is preferably made of a water insoluble, non-corrosive, solid material. The catalyst should be chemically stable, inert, substantially water insoluble, non-toxic and harmless in contact with food stuffs. The catalyst is preferably a mixture of pulverized palladium or platinum and alumina or carbon. The carbon is advantageously activated carbon. The basket 70 is suspended by attaching it to a steel cap 74 having a threaded surface which screws into the top 24. Wire 42 is projected through the center of steel cap 74 and basket 70 into interior 22. A plastic insert 76 and a rubber seal 78 are generally fitted within steel cap 74 to position and electrically insulate wire 42 with respect to steel cap 74 and basket 70. An insulating paper 80 is positioned around the wire 44 between steel cap 74 and the top 24.

The lower voltage requirements of this novel non-sacrificial anode produce a lower build-up of hydrogen and oxygen gas than conventional non-sacrificial anodes. The catalyst further inhibits the build-up of hydrogen and oxygen gas, thus further increasing the safety factor of this non-sacrificial anode and hot water heater design.

Figure 5:
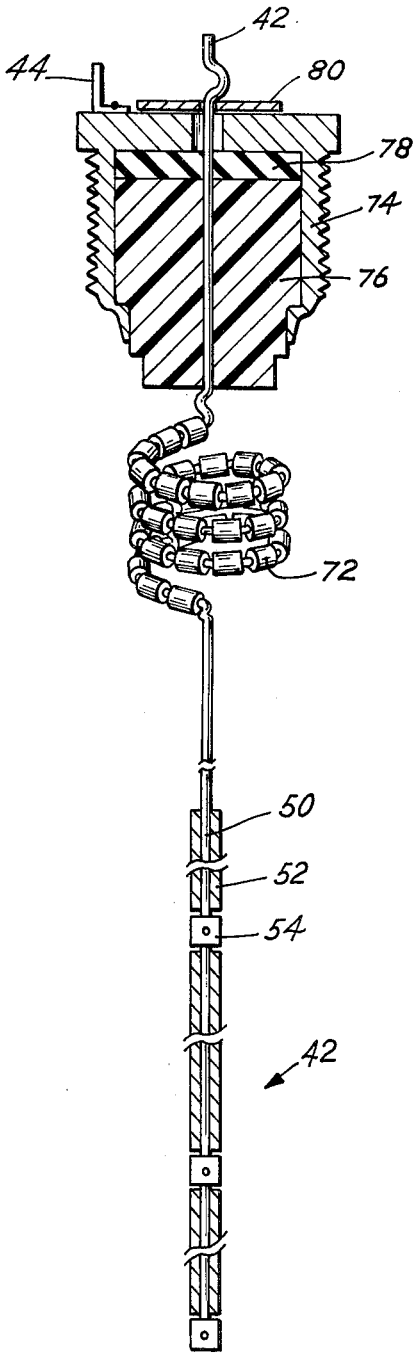
FIG. 5 is a cross-sectional view of a first alternative embodiment of the catalyst and sacrificial anode assembly described herein.
Figure 6:
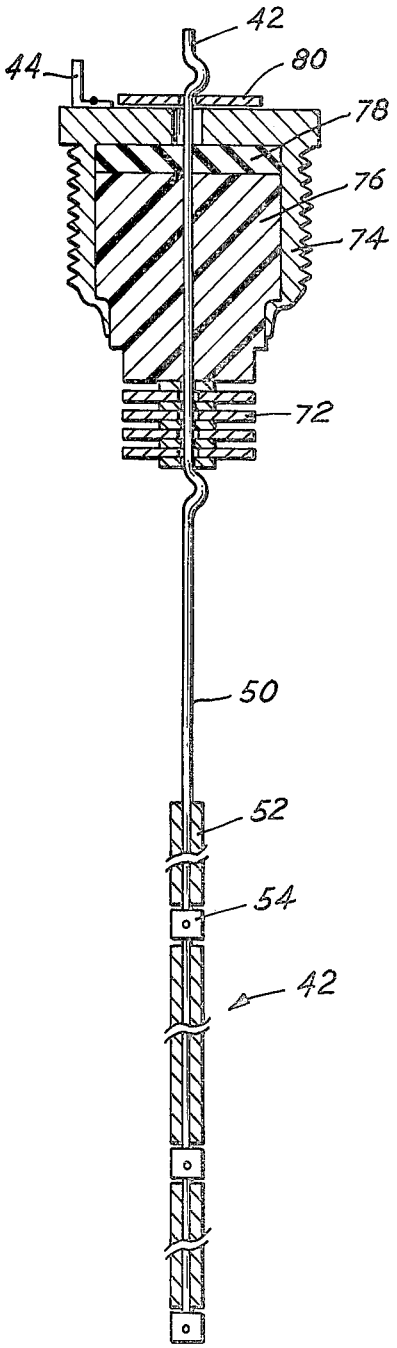
FIG. 6 is a cross-sectional view of a second alternative embodiment of the catalyst and sacrificial anode assembly described herein.

FIGS. 5 and 6 show alternative configurations for the arrangement of catalyst 72. FIG. 5 shows the catalyst as cylindrical pellets with a central passageway. The pellets are strung on the elongated wire 42 near the steel cap 74. FIG. 6 shows how the catalyst could be made in flat, planar members and mounted on wire 42 near the steel cap 74. The consideration for choosing the configuration of the catalyst include active surface area of the catalyst and diffusion paths for the oxygen and hydrogen gas as well as other characteristics conventionally known in the art.

The above description relates to a preferred embodiment of the invention. The preferred configuration is described and illustrated in the drawing. However, alternative configurations and modifications are possible within the scope of the invention. For example, the number of the distribution anode points 54 may be changed; the configuration of wire 42 may be altered although the wire may be retained as a single filament. The materials used in making the wire and the anode distribution points may be varied. The location of the catalyst may be isolated from the location of the wire 42; and the materials used to make the catalyst may be changed. Therefore, the subject matter of the invention is limited only by the following claims and their equivalents.

What is claimed is:

1. In a hot water heater comprising, a substantially hollow metal tank having an interior surface, said tank being formed at least in part of a galvanically active material, heating means for heating water in the tank and a non-sacrificial anode means adopted to direct an electrically positive current from within said tank to said interior surface when said tank is filled with water the improvement comprising a catalyst means for catalyzing hydrogen gas and oxygen gas formed within the tank due to electrolysis of water resulting from operation of the non-sacrificial anode means to form water molecules within the tank, said catalyst means being disposed near the top of said tank and being chemically stable, inert, substantially water insoluble, non-toxic and harmless in contact with food stuffs.

2. The hot water heater of claim 1 wherein said catalyst means comprises palladium or platinum mixed with a component selected from the group consisting of alumina and carbon.

3. The hot water heater of claim 2 wherein said palladium, platinum, alumina and carbon are pulverized.

4. The hot water heater of claim 2 wherein said carbon comprises activated carbon.

5. The hot water heater of claim 1 further comprising a porous basket made from a water insoluble, non-corrosive solid material, said basket being attached to said tank, said catalyst means being disposed as pellets within said basket.

6. The hot water heater of claim 1 wherein said catalyst means is formed as pellets having central passageways and including a suspending member projecting through said central passageways.

7. The hot water heater of claim 1 wherein said catalyst means is formed as flat planar members and including a support member, said planar members being mounted on the support member.

8. The improvement of claim 1 in combination with a non-sacrificial anode, said anode comprised of a wire electrode projecting into said tank, said wire electrode being generally insulated from the tank and including a plurality of separate anode members attached thereto at intervals along the wire electrode for directing current discharge and thereby protecting the tank.

9. In a hot water heater tank for containing and heating water and which includes an interior surface, said interior surface being formed at least in part of a galvanically active material, means for heating the contents of the tank, and a non-sacrificial anode positioned within the tank adapted to direct an electrically positive current therefrom to the interior surface, the improvement comprising:

an elongated wire electrode within said tank having a plurality of discrete, spaced, anodic elements attached thereto along the length of wire electrode, said wire electrode comprised of a titanium material and being electrically insulated from the contents of the tank, said anodic elements being platinum coated tantalum members which are affixed to the wire electrode.

10. The improvement of claim 9 including catalyst means positioned within the tank adjacent the top of the tank for catalyzing hydrogen and oxygen gases into water, said gases being formed by hydrolysis of water within the tank resulting from operation of the anode.

11. The improvement of claim 10 wherein said catalyst comprises a metal selected from the group consisting of palladium and platinum mixed with a component selected from the group consisting of alumina and carbon.

12. The improvement of claim 10 wherein said catalyst comprises a pulverized catalyst material.

13. The improvement of claim 10 wherein said catalyst comprises a metal selected from the group consisting of palladium and platinum mixed with a component selected from the group consisting of alumina and activated carbon.

14. The improvement of claim 9 wherein said wire electrode is insulated at least in part by an insulating material clad on the wire electrode.

15. The improvement of claim 9 wherein said wire electrode is insulated at least in part by an oxide layer formed on the wire electrode.

16. The improvement of claim 9 wherein said tantalum members are arranged on the wire at pre-selected positions such that the sum of electrical resistances between said plurality of anode members and each one of a number of separate localized areas on the interior surface is substantially constant.

17. The improvement of claim 16 wherein said wire electrode is fabricated from a titanium material.

18. The improvement of claim 16 wherein said anode member is comprised of a tantalum material clad with a platinum material.

* * * * *